US007242881B2

(12) United States Patent
Taki et al.

(10) Patent No.: US 7,242,881 B2
(45) Date of Patent: Jul. 10, 2007

(54) IMAGE FORMING APPARATUS HAVING ADVANCED FIXING SYSTEM

(75) Inventors: Kenji Taki, Hino (JP); Hiroyuki Arai, Hachioji (JP); Chikatsu Suzuki, Hachioji (JP); Fusako Akimoto, Sagamihara (JP)

(73) Assignee: Konica Minolta Business Technologies, Inc. (JP)

( * ) Notice: Subject to any disclaimer, the term of this patent is extended or adjusted under 35 U.S.C. 154(b) by 161 days.

(21) Appl. No.: 11/006,208

(22) Filed: Dec. 6, 2004

(65) Prior Publication Data

US 2005/0254845 A1 Nov. 17, 2005

(30) Foreign Application Priority Data

May 14, 2004 (JP) ..... 2004-144808

(51) Int. Cl.
*G03G 15/00* (2006.01)

(52) U.S. Cl. ..... 399/45; 399/69; 399/328; 399/330; 399/331; 399/67; 219/216

(58) Field of Classification Search ..... 399/45
See application file for complete search history.

(56) References Cited

U.S. PATENT DOCUMENTS

| | | | | |
|---|---|---|---|---|
| 6,201,938 | B1 * | 3/2001 | Hollar et al. | 399/67 |
| 6,687,468 | B2 * | 2/2004 | Holubek et al. | 399/45 |
| 7,039,332 | B2 * | 5/2006 | Suzuki | 399/45 |
| 2002/0176724 | A1 * | 11/2002 | Fuma et al. | 399/328 |

* cited by examiner

*Primary Examiner*—David M. Gray
*Assistant Examiner*—Ryan D. Walsh
(74) *Attorney, Agent, or Firm*—Squire, Sanders & Dempsey L.L.P.

(57) ABSTRACT

An image forming apparatus including: a fixing device for fixing a toner image formed on a recording medium onto the recording medium, the fixing device comprising a first fixing member equipped with a heating device and a second fixing member for making pressure contact of the recording medium to the first fixing member; a moving section for relatively moving the first fixing member and the second fixing member; a temperature detector for detecting a temperature of the first fixing member; and a controller for controlling the moving section so as to reduce a relative distance between the first fixing member and the second fixing member, when the temperature of the first fixing member detected by the temperature detector is higher than a predetermined temperature.

10 Claims, 9 Drawing Sheets

FIG. 2

111

| WEIGHT OF PAPER | PLAIN PAPER | | COATED PAPER | |
|---|---|---|---|---|
| | GLOSSY | NON-GLOSSY | GLOSSY | NON-GLOSSY |
| 64～74g / $m^2$ | 200℃ | 210℃ | 175℃ | 185℃ |
| 75～79g / $m^2$ | | | | |
| 80～105g / $m^2$ | | | 185℃ | 195℃ |
| 106～162g / $m^2$ | 210℃ | 220℃ | 190℃ | 200℃ |
| 163～209g / $m^2$ | | | | |
| 210～256g / $m^2$ | | | | |

FIG. 5 ( a )
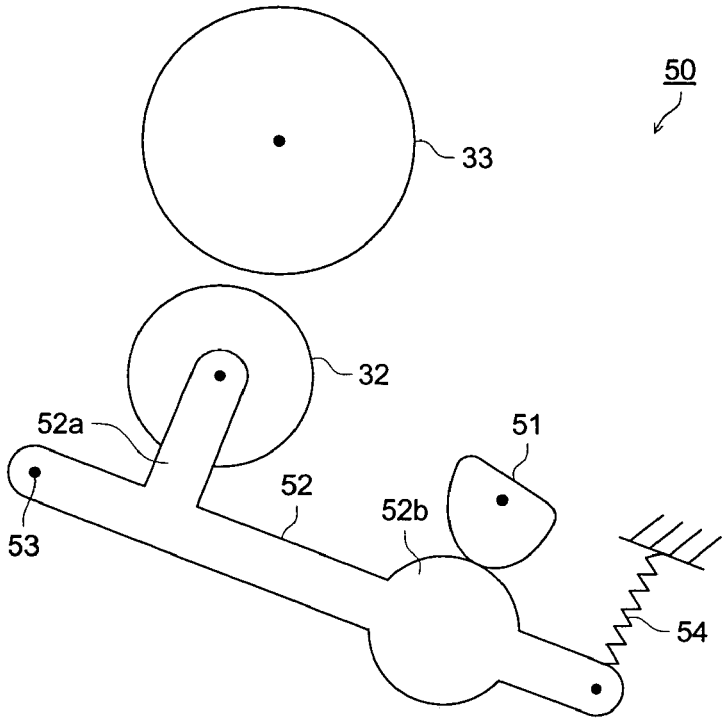
FIG. 5 ( b )
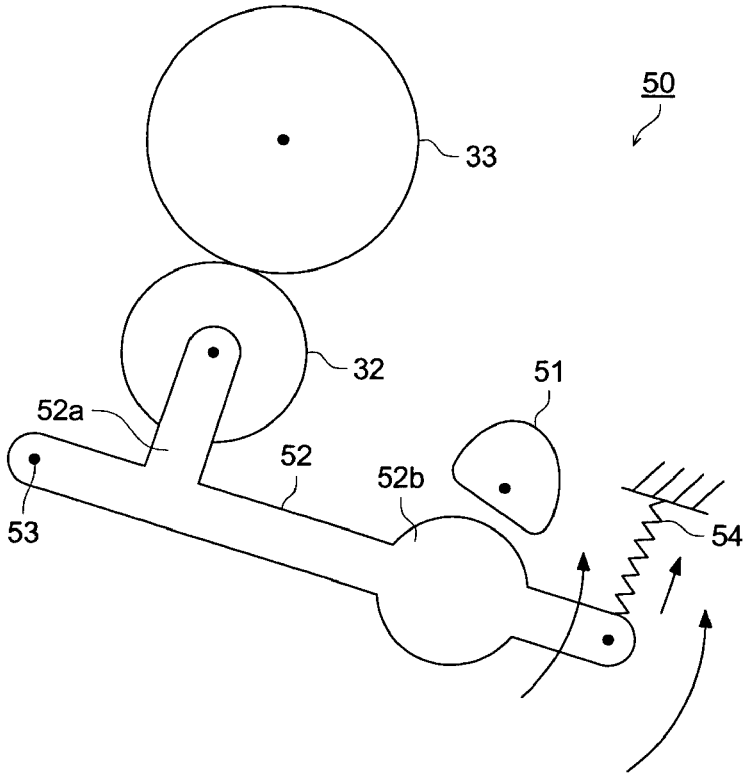

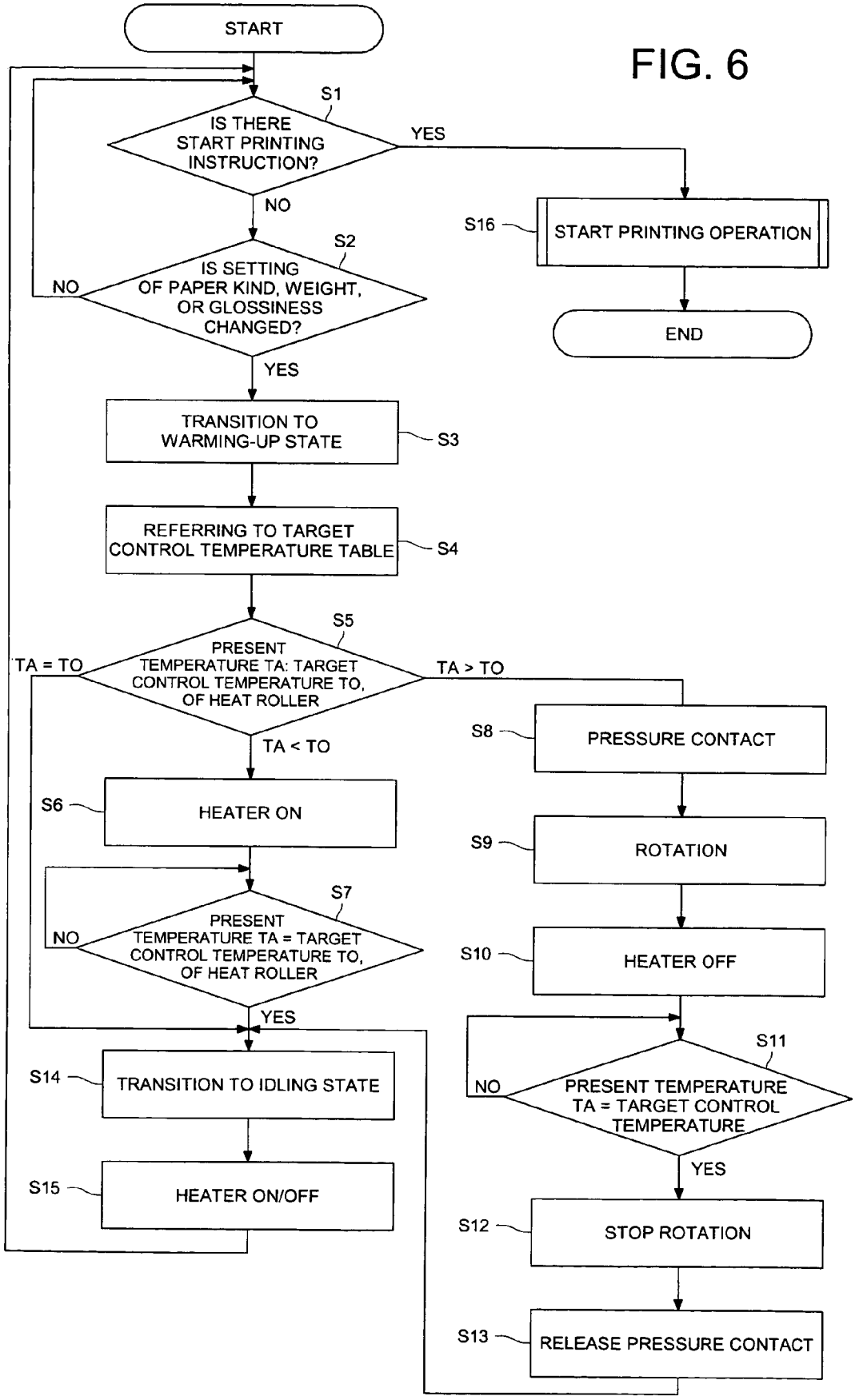
START
FIG. 6
S1
IS THERE START PRINTING INSTRUCTION?
YES
NO
S16
START PRINTING OPERATION
END
S2
IS SETTING OF PAPER KIND, WEIGHT, OR GLOSSINESS CHANGED?
NO
YES
TRANSITION TO WARMING-UP STATE
S3
REFERRING TO TARGET CONTROL TEMPERATURE TABLE
S4
S5
PRESENT TEMPERATURE TA: TARGET CONTROL TEMPERATURE TO, OF HEAT ROLLER
TA = TO
TA > TO
TA < TO
S8
PRESSURE CONTACT
S6
HEATER ON
S9
ROTATION
S7
PRESENT TEMPERATURE TA = TARGET CONTROL TEMPERATURE TO, OF HEAT ROLLER
NO
S10
HEATER OFF
YES
S11
PRESENT TEMPERATURE TA = TARGET CONTROL TEMPERATURE
NO
S14
TRANSITION TO IDLING STATE
YES
S15
HEATER ON/OFF
S12
STOP ROTATION
S13
RELEASE PRESSURE CONTACT

FIG. 7

| 210℃→190℃ | FIRST TIME | SECOND TIME | THIRD TIME | AVERAGE VALUE |
|---|---|---|---|---|
| RELEASED STATE OF PRESSURE CONTACT | 2:25 | 2:31 | 2:35 | 2:30 |
| PRESSURE CONTACT STATE | 1:43 | 1:47 | 1:38 | 1:43 |

IMAGE FORMING APPARATUS HAVING ADVANCED FIXING SYSTEM

BACKGROUND OF THE INVENTION

The present invention relates to an image forming apparatus, particularly to an image forming apparatus equipped with a fixing device.

Generally, in an electrophotographic image forming apparatus, a toner image based on image data is formed on a recording medium, and the recording medium with a toner image formed thereon is fed to a fixing device, where an unfixed toner image is fixed on the recording medium to get a printed image.

For example, the fixing device contains a heating roller as a heating member with a heater incorporated inside, and a pressure roller as a pressure member for forming a fixing nip through pressure contact with the heating roller. The heating roller and pressure roller apply heat and pressure while conveying a recording medium by sandwiching it with a fixing nip, and a toner image is fused on the recording medium.

The optimum fixing temperature differs according to the kind, weight and glossiness of the recording medium. For example, if the fixing temperature is too high, the coated paper whose surface is provided with special coating will be subjected to a blister where a blister-like defect appears on the surface. Conversely, if the fixing temperature is too low, fixing failure will occur to the paper of greater weight (as in thick paper). In color printing, the glossiness of the recording medium to be printed and outputted is adjusted by changing the fixing temperature in response to the glossiness specified by a user.

If the present temperature if the heating member is not the optimum fixing temperature, the image forming apparatus is put to the status of warm-up operation, and waits in that status until the present temperature of the heating member reaches the optimum temperature. To increase the temperature of the heating roller, the heater incorporated in the heating member is turned on. To decrease the temperature of the heating roller, the heater is turned off and the apparatus waits until the optimum temperature is reached by natural cooling.

The art of reducing the warm-up operation time is disclosed in the Patent Document 2, for example, wherein the target value of the fixing temperature is increased only when a recording medium made of special material such as thick paper or OHP sheet (overhead transparency film) has been specified, and the heating member and pressure member are rotated by pressure contact for a certain period of time during warm-up operation so that the pressure member is made warm, whereby the heat of the heating member is not deprived of by the pressure member when printing is started, and therefore, fixing failure is prevented.

[Patent Document 1] Official Gazette of Japanese Patent Tokkohei 7-58414

Incidentally, during the warm-up operation for reducing the temperature of the heating member, the pressure of the heating member and pressure member is released, and the apparatus is made to wait until the optimum temperature is reached by natural cooling.

However, when reducing the temperature of the heating member to the optimum temperature by natural cooling, much longer time is required than when increasing the temperature. During this time, printing cannot be started. Such a problem has remained unsolved in the prior art.

In view of the prior art described above, it is an object of the present invention to provide an image forming apparatus capable of reducing the warm-up operation time for reducing the temperature of the fixing member equipped with a heating means, down to the temperature lower than the present level.

SUMMARY OF THE INVENTION

The aforementioned object can be achieved by an image forming apparatus having the following structures:

(1) An image forming apparatus including: a fixing device for fixing a toner image formed on a recording medium onto the recording medium, the fixing device comprising a first fixing member equipped with a heating device and a second fixing member for making pressure contact of the recording medium to the first fixing member; a moving section for relatively moving the first fixing member and the second fixing member; a temperature detector for detecting a temperature of the first fixing member; and a controller for controlling the moving section so as to reduce a relative distance between the first fixing member and the second fixing member, when the temperature of the first fixing member detected by the temperature detector is higher than a predetermined temperature.

(2) The image forming apparatus described in (1), wherein each of the first fixing member and the second fixing member is a body of rotation.

(3) The image forming apparatus described in (2), wherein each of the first fixing member and the second fixing member is a roller, and wherein the controller controls the moving section so as to reduce a distance between each of the rotary axes of the first fixing member and the second fixing member, when the temperature of the first fixing member detected by the temperature detector is higher than the predetermined temperature.

(4) The image forming apparatus described in (1), wherein the controller controls the moving section so as to reduce the relative distance between the first fixing member and the second fixing member that are in the disengaged state with each other, when the temperature of the first fixing member detected by the temperature detector is higher than the predetermined temperature.

(5) The image forming apparatus described in (1), wherein the controller controls the moving section so as to reduce the relative distance between the first fixing member and second fixing member, when the temperature of the first fixing member detected by the temperature detector during warm-up operation or idling operation is higher than the predetermined temperature.

(6) The image forming apparatus described in (1), wherein the predetermined temperature level is a temperature determined in advance.

(7) The image forming apparatus described in (1), wherein the predetermined temperature level is the target control temperature of the first fixing member.

(8) The image forming apparatus described in (1), further including a recording medium kind setting section for setting the kind of the recording medium, wherein the predetermined temperature level is the temperature conforming to the kind of the recording medium set by the recording medium setting section.

(9) The image forming apparatus described in (8), wherein the recording medium setting section is capable of setting the weight of a recording medium, and the predetermined temperature level is the temperature conforming to the weight of the recording medium set by the recording medium setting section.

(10) The image forming apparatus described in (8), wherein the recording medium setting section is capable of setting the glossiness of a recording medium, and the predetermined temperature level is the temperature conforming to the glossiness of the recording medium set by the recording medium setting section.

(11) The image forming apparatus described in (1), wherein the control section controls the moving section in such a way that the first fixing member comes in pressure-contact with the second fixing member, when the temperature of the first fixing member detected by the temperature detecting section is higher than a predetermined level.

(12) The image forming apparatus described in (4), wherein the moving section is capable of moving at least one of the second fixing member and the first fixing member between a pressure-contact position where the second fixing member is kept in pressure-contact with the first fixing member, and a release position where the second fixing member is disengaged from the first fixing member, and wherein the controller controls the moving section in such a way that at least one of the second fixing member and the first fixing member moves from the release position in a direction to the pressure contact position, when the temperature of the first fixing member detected by the temperature detector is higher than the predetermined temperature.

(13) The image forming apparatus described in (12), wherein the controller controls the moving section in such a way that the second member comes in pressure contact with the first fixing member, when the temperature of the first fixing member detected by the temperature detector is higher than the predetermined temperature.

(14) The image forming apparatus described in (13), further including a rotating section for rotating at least one of the first fixing member and the second fixing member, wherein the controller controls the moving section in such a way that at least one of the first fixing member and the second fixing member rotates, when the temperature detected by the temperature detector is higher than the predetermined temperature.

(16) The image forming apparatus described in (8), wherein the controller controls the moving section so as to reduce the relative distance between the first fixing member and the second fixing member, in cases where a changed kind of the recording medium has been set by the recording medium setting section, and the temperature of the first fixing member detected by the temperature detector is higher than a predetermined temperature conforming to the changed kind of the recording medium being set by the recording medium setting section.

(17) The image forming apparatus described in (9), wherein the controller controls the moving section so as to reduce the relative distance between the first fixing member and the second fixing member, in cases where a changed weight of the recording medium has been set by the recording medium setting section, and the temperature of the first fixing member detected by the temperature detector is higher than a predetermined temperature conforming to the changed weight of the recording medium being set by the recording medium setting section.

(18) The image forming apparatus described in (10), wherein the controller controls the moving section so as to reduce the relative distance between the first fixing member and the second fixing member, in cases where a changed glossiness of the recording medium has been set by the recording medium setting section, and the temperature of the first fixing member detected by the temperature detector is higher than a predetermined temperature conforming to the changed glossiness of the recording medium being set by the recording medium setting section.

(19) An image forming apparatus including: a recording medium setting section for setting a kind of a recording medium; a fixing device for fixing a toner image formed on a recording medium onto the recording medium, the fixing device comprising a first fixing member equipped with a heating device and a second fixing member for making pressure contact of the recording medium to the first fixing member; a moving section for relatively moving the first fixing member and the second fixing member; and a controller for controlling the moving section so as to reduce a relative distance between the first fixing member and the second fixing member, when a second target control temperature of the first fixing member conforming to a second kind of the recording medium set by the recording medium setting section is lower than a first target control temperature conforming to a first kind of the recording medium which had been previously set.

(20) The image forming apparatus described in (19), wherein each of the first fixing member and the second fixing member is a body of rotation.

(21) The image forming apparatus described in (20), wherein each of the first fixing member and the second fixing member is a roller, and wherein the controller controls the moving section so as to reduce a distance between each of rotary axes of the first fixing member and the second fixing member, when the second target control temperature of the first fixing member conforming to the second kind of the recording medium set by the recording medium setting section is lower than the first target control temperature conforming to the first kind of the recording medium which had been previously set.

(22) The image forming apparatus described in (19), wherein the controller controls the moving section so as to reduce the relative distance between the first fixing member and second fixing member that are in the disengaged state with each other, when the second target control temperature of the first fixing member conforming to the second kind of the recording medium set by the recording medium setting section is lower than the first target control temperature conforming to the first kind of the recording medium which had been previously set.

(23) The image forming apparatus described in (19), wherein the controller controls the moving section so as to reduce the relative distance between the first fixing member and the second fixing member, in cases where a changed kind of the recording medium has been set by the recording medium setting section, and a target control temperature of the first fixing member conforming to the changed kind of the recording medium is lower than a target control temperature conforming to a kind of the recording medium which had been set before the changed kind of the recording medium.

(24) The image forming apparatus described in (19), wherein the recording medium setting section is capable of setting a weight of a recording medium, and wherein the first target control temperature is a temperature conforming to the weight of the first recording medium, and the second target control temperature is a temperature conforming to the weight of the second recording medium.

(25) The image forming apparatus described in (19), wherein the recording medium setting section is capable of setting a glossiness of a recording medium, and wherein the first target control temperature is a temperature conforming to the glossiness of the first recording medium, and the second target control temperature is a temperature conforming to the glossiness of the second recording medium.

(26) The image forming apparatus described in (23), wherein the controller controls the moving section in such a way that the second fixing member comes in pressure contact with the first fixing member, when the target control temperature of the first fixing member conforming to the changed kind of the recording medium is lower than the target control temperature conforming to the kind of the recording medium which had been set before the changed kind of the recording medium.

(27) The image forming apparatus described in (22), wherein the moving section is capable of moving at least one of the second fixing member and the first fixing member between a pressure-contact position where the second fixing member is kept in pressure-contact with the first fixing member and a release position where the second fixing member is disengaged from the first fixing member, and wherein the controller controls the moving section in such a way that at least one of the second fixing member and the first fixing member moves from the release position in the direction to the pressure-contact position, in cases where a changed kind of the recording medium has been set by the recording medium setting section, and a target control temperature of the first fixing member conforming to the changed kind of the recording medium is lower than a target control temperature conforming to a kind of the recording medium which had been set before the changed kind of the recording medium.

(28) The image forming apparatus described in (27), wherein the controller controls the moving section in such a way that the second member comes in pressure-contact with the first fixing member, when a target control temperature of the first fixing member conforming to the changed kind of the recording medium is lower than the target control temperature conforming to the kind of the recording medium which had been set before the changed kind of the recording medium.

(29) The image forming apparatus described in (28), further including a rotating section for rotating at least one of the first fixing member and the second fixing member, wherein the controller controls the moving section in such a way that at least one of the first fixing member and the second fixing member rotates, when a target control temperature of the first fixing member conforming to the changed kind of the recording medium is lower than the target control temperature conforming to the kind of the recording medium which had been set before the changed kind of the recording medium.

(30) The image forming apparatus described in (19), wherein the moving section is capable of adjusting a contact pressure of the second fixing member to the first fixing member.

(31) The image forming apparatus described in (19), further including a temperature detector for detecting a temperature of the first fixing member, wherein the controller controls the moving section so as to reduce the relative distance between the first fixing member and the second fixing member, when the temperature of the first fixing member detected by the temperature detector is higher than the target control temperature of the first fixing member conforming to the kind of the recording medium set by the recording medium setting section.

BRIEF DESCRIPTION OF THE DRAWINGS

FIG. 2 is a diagram showing an example of data storage in a target control temperature table 111;

FIG. 5 is a cross sectional view representing an example of the configuration of a pressure contact drive device 50;

FIG. 6 is a flowchart representing the heating roller temperature control provided by a controller 101;

FIG. 7 is a diagram showing time required for the temperature to fall from 210 to 190° C., when pressure contact of the heating roller 33 and pressure roller 32 has been released;

DETAILED DESCRIPTION OF THE PREFERRED EMBODIMENT

The following describes the details of the preferred embodiments of the present invention with reference to drawings.

The configuration will be described first.

Figure 1:
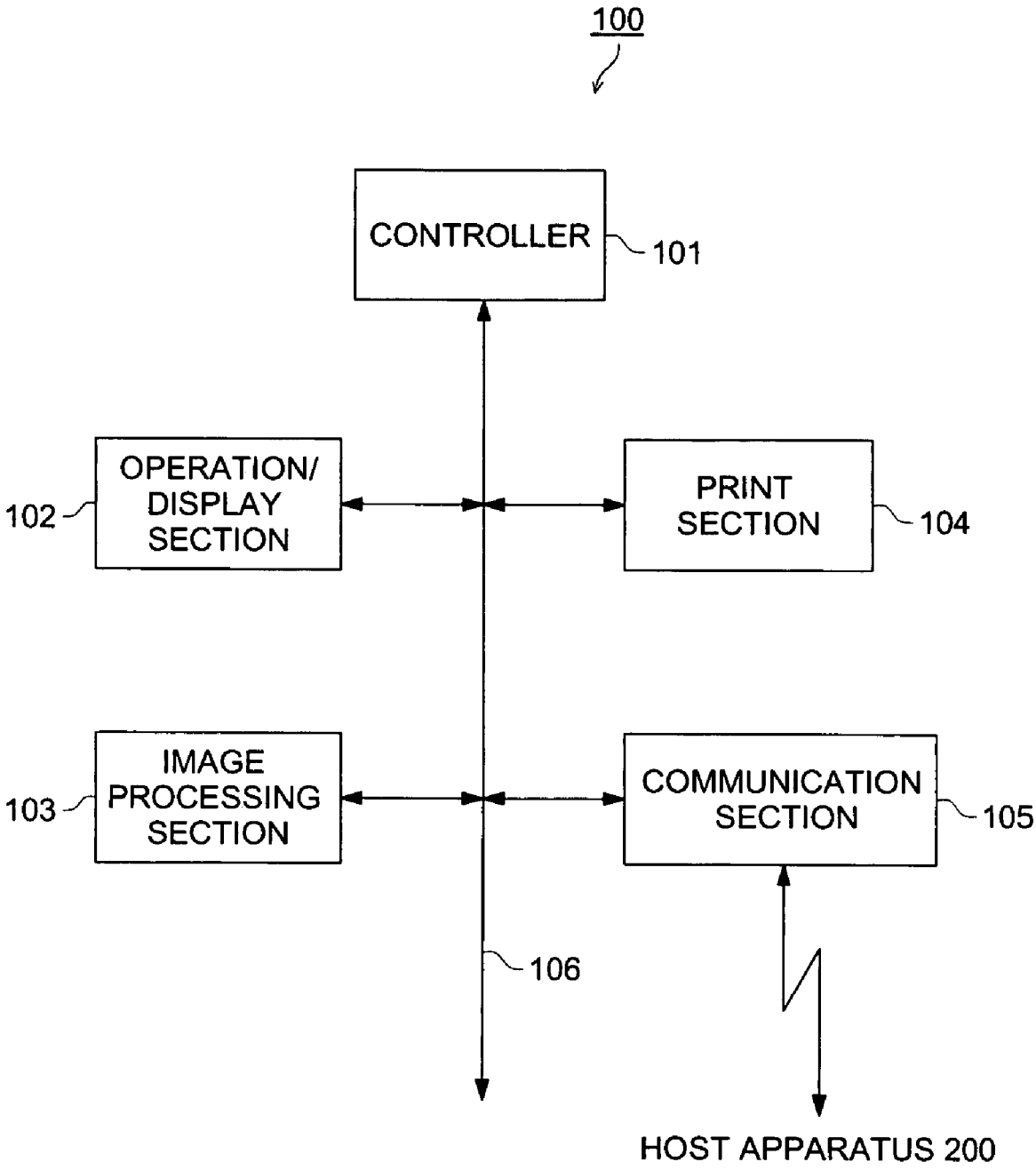
FIG. 1 is a block diagram showing the functional configuration of an image forming apparatus 100 of the present invention.

FIG. 1 shows an example of the configuration of an image forming apparatus 100 of the present invention. The image forming apparatus 100 is exemplified by an electrophotographic color printer. As shown in FIG. 1, the controller 101 includes an operation/display section 102, an image processing section 103, a print section 104 and a communication section 105. Each section is connected by means of a bus 106.

The controller 101 includes a CPU (Central Processing Unit), a ROM (Read Only Memory) and a RAM (Random Access Memory). The CPU of the controller 101 reads the system program and various processing programs stored in the ROM by the operation of the controller 101, and expands them on the RAM. The operation of the image forming apparatus 100 is centrally controlled according to the expanded program. According to the expanded program, the CPU of the controller 101 executes various kind of processing including the heating roller temperature control to be described later.

The target control temperature table 111 shown in FIG. 2 is stored in the ROM of the controller 101.

As shown in FIG. 2, the target control temperature table 111 stores the information on the target control temperature conforming to the print conditions of the kind (paper kind (e.g. plain paper, coated paper, etc.), glossiness (e.g. glossy, not glossy) and weight (e.g. 64 through 74 g/m$^2$, 75 through 79 g/m$^2$, 80 through 105 g/m$^2$) of the recording medium P for recording an image in the print section 104. Here the target control temperature is defined as the control target value of the temperature of the heating roller as a first fixing member.

The operation/display section 102 includes an LCD (liquid crystal display) and, displays the operation buttons and apparatus status on the display screen according to the instruction of the display signal inputted from the controller 101. The surface of the LCD display screen is covered with a touch panel of the pressure sensitive (resistive film thickness kind) composed of transparent electrodes arranged in a grid pattern. The X and Y coordinates of the power point depressed by a finger or a touch pen is detected in terms of voltage values, and the detected position signal is outputted to the controller 101 as an operation signal. The operation/display section 102 is equipped with various kinds of operation buttons such as numeric keys and start buttons, and sends the operation signal by the button operation to the controller 101.

The image processing section 103 converts the printer code received by the communication section 105, into the binary code, and outputs the converted image data to the print section 104.

The print section 104 forms and outputs an image on the recording medium P under the control of the controller 101, based on the image data processed by the image processing section 103.

Figure 3:
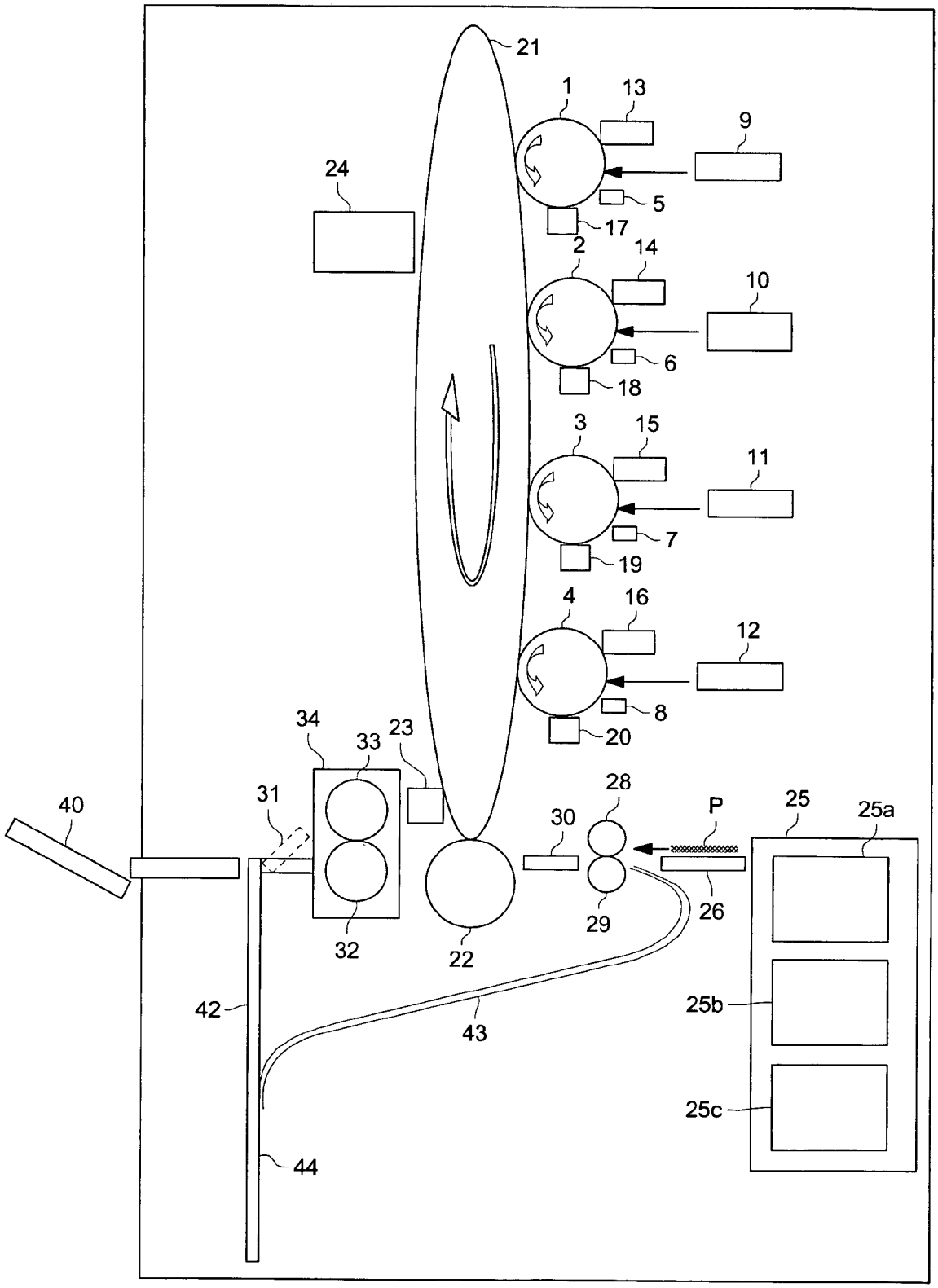
FIG. 3 is a drawing showing the internal structure of a print section 104.

FIG. 3 shows the major structure of the print section 104. As shown in FIG. 3, the print section 104 comprises:

photoconductor drums 1 through 4 for yellow, magenta, cyan and black;

exposure sections 9 through 12 for forming an electrostatic latent image by applying a laser beam to the photoconductor drums 1 through 4;

charging devices 5 through 8 for charging the surface of the photoconductor drums 1 through 4;

developing devices 13 through 16 for forming a toner image on the electrostatic latent image formed on the photoconductor drums 1 through 4;

an intermediate transfer member 21 for conveying the toner image formed on the photoconductor drums 1 through 4, to the recording medium P;

a transfer roller 22 for transferring the toner image formed on the intermediate transfer member 21, to the recording medium P; and a fixing device 34 for fixing the toner image on the recording medium P.

In FIG. 3, the following printing operation is carried out.

The photoconductor drums 1 through 4 are driven by a main motor (not illustrated). Their surfaces are negatively charged (−800 volts in the present embodiment) by the discharge of the charging devices 5 through 8 supplied with voltage from a power source (not illustrated). Optical writing conforming to the image data of each color is made to the charged portion through exposure to the laser beam of the exposure sections 9 through 12, whereby a electrostatic latent image is formed. When the formed electrostatic latent image has passed through the developing devices 13 through 16, the toner negatively charged within the developing device by the power source (not illustrated) is attached to the latent image portion by application of the negative development bias, with the result that toner images are formed on the photoconductor drums 1 through 4. The toner images formed in the aforementioned manner are transferred on an intermediate basis to the intermediate transfer member 21 that is in pressure contact with the photoconductor drums 1 through 4. The toner on the photoconductor drums 1 through 4 remaining after intermediate transfer is removed by cleaning section 17 through 20.

In the meantime, the recording media P are fed one by one from the sheet feed tray 25 (any one of "a" through "c"). They are guided from the guide plate 26 to proceed to the registration rollers 28 and 29. After the leading edge of the recording medium P has been adjusted by the registration rollers 28 and 29, the recording medium is fed out when the toner image on the intermediate transfer member 21 is matched with the image position. Guided by the guide plate 30, the recording medium is fed to the transfer nip portion as a position of contact between the intermediate transfer member 21 and transfer roller 22. The transfer roller 22 presses the recording medium P toward the intermediate transfer member 21. An toner image on the intermediate transfer member 21 is transferred to the recording medium P by the action of the electrostatic force generated at the bias (+500 volts), reverse to the toner, applied by the power source (not illustrated).

The electric charge of the recording medium P carrying a toner image is eliminate by a separation section 23 consisting of an electric charge eliminating needle. The recording medium P is separated from the intermediate transfer member 21, and is fed to the fixing device 34 consisting of a pair of rollers—a heating roller 33 and a fixing device 34. The fixing device 34 will be described later. (See FIGS. 4 and 5).

The recording medium P with a toner image heat-fixed by the fixing device 34 passes through the simplex/duplex switching gate 31 and is ejected to be stored in the ejection tray 40.

In the duplex printing mode, the recording medium P is fed to the reversing path 42 by operating the simplex/duplex switching gate 31, and is reversed at a reversing point 44. Being fed along the duplex path 43, the recording medium P proceeds to the registration rollers 28 and 29. After the leading edge of the recording medium P has been adjusted by the registration rollers 28 and 29, the reverse side of the recording medium P is subjected to intermediate transfer in the manner similar to that in the case of the obverse side, and an image is fixed on the recording medium P, which is then ejected.

A cleaning device 24 including a blade is used to remove the toner remaining on the obverse side of the intermediate transfer member 21 subsequent to passing through the transfer nip portion. The aforementioned printing operation is repeated thereafter.

Figure 4:
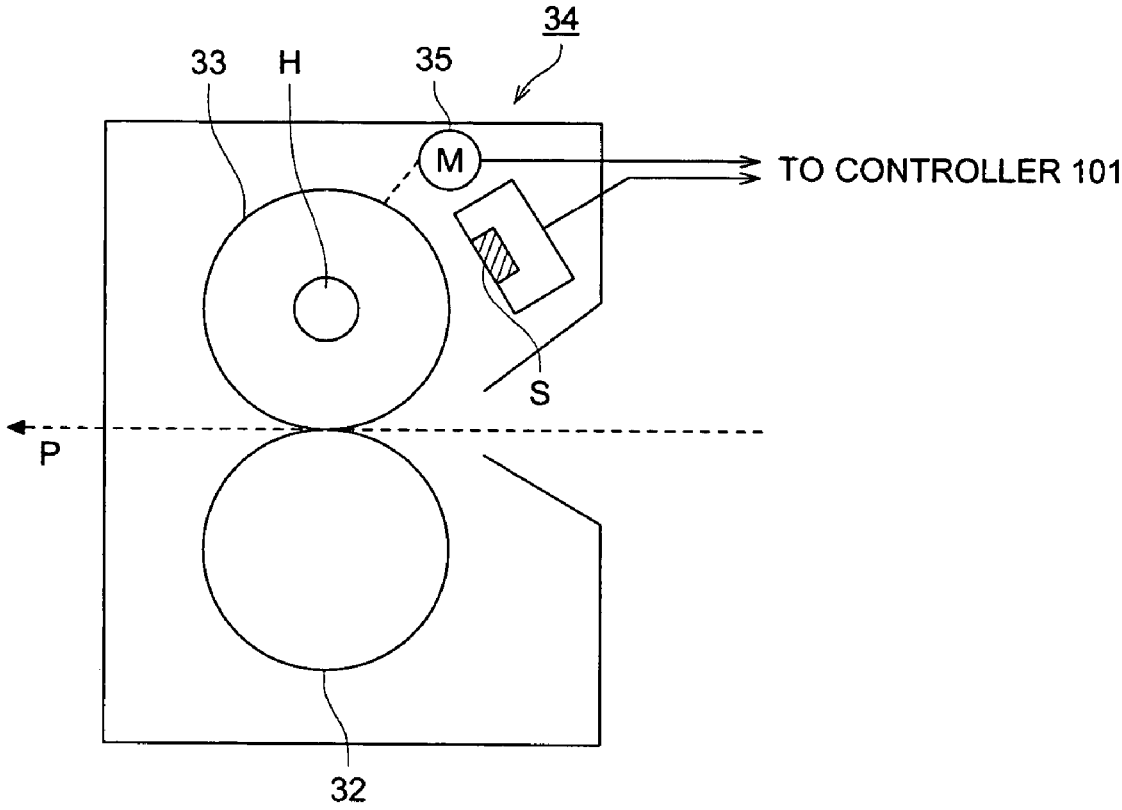
FIG. 4 is a diagram showing an example of the configuration of a fixing device 34.

The following describes the fixing device 34:

As shown in FIG. 4, the fixing device 34 contains:

a heating roller 33 as a heating member with a built-in heating means H such as a halogen lamp heater;

a motor 35 for rotating and driving the heating roller 33; and a pressure roller 32 as a pressure member for forming a fixing nip by allowing the pressure contact drive device 50 (FIG. 5) to apply a contact pressure to the heating roller 33. In addition to the halogen lamp heater, an induction heater and others may be used as the heating means H.

In this embodiment, the heating roller is used as a first fixing member, and the pressure roller is used as a second fixing member. However, various kinds of rotary bodies can be used as the first and second fixing members. Further, in the present embodiment, the heating means H is built in the heating roller 33 as the first fixing member. Without being restricted thereto, it is also possible to make such arrangements that the heating roller 33 is heated from outside the heating roller 33.

FIG. 5 shows an example of the configuration of the pressure contact drive device 50. It is a drawing representing the cross section of the heating roller 33. In this view, (*a*) indicates that the pressure roller 32 is disengaged from the heating roller 33 (where pressure contact is released), and (*b*) represents the state where the pressure roller 32 and the heating roller 33 are brought in pressure contact with each other.

As shown in FIGS. 5(*a*) and (*b*), the base end of the arm 52 is journaled by the fulcrum 53 and is supported by the arm 52 rotatably about the fulcrum 53. The base end of the arm 52 is energized by a spring so as to be pulled toward the heating roller 33. The base end of the arm 52 is provided with a protrusion 52*a* projecting toward the heating roller 33. On its tip end the pressure roller 32 is rotatably journaled. An approximately semi-circular guide projection 52*b* projecting in the same direction as the protrusion 52*a* is arranged on the tip end of the arm 52. An approximately semi-circular cam 51 is mounted rotatably in the circumferential direction in such a way that it can come into sliding contact with the outer periphery of the guide projection 52*b*. The rotary shaft of the cam 51 is connected with the rotary shaft of a drive motor (not illustrated). The cam installation position is adjusted in such a way that the pressure roller 32 will be disengaged from the heating roller 33 when the curved surface has come into sliding contact with the guide projection 52*b*, and the pressure roller 32 and the heating roller 33 will be brought in pressure contact with each other when the flat surface is faced with the guide projection 52*b*.

If a pressure contact release command of the pressure roller 32 is issued from the controller 101, the cam 51 is driven by a drive motor (not illustrated) as shown in FIG. 5(*a*), and the curved surface of the cam 51 comes in sliding contact with the guide projection 52*b*. Then the arm 52 rotates about the fulcrum 53 in the counterclockwise direction against the force of the spring member 54. The outer periphery of the pressure roller 32 is disengaged from the outer periphery of the heating roller 33 by the rotation of the arm 52, whereby pressure contact is released.

In the meantime, when a pressure command of the pressure roller 32 is issued from the controller 101, the cam 51 is driven by the drive motor (not illustrated), as shown in FIG. 5(*b*). When the flat surface of the cam 51 faces the guide projection 52*b*, the rotation of the arm 52 is released, and therefore, the arum 52 is pulled toward the heating roller 33 by the force of the spring member 54, with the result that counterclockwise rotation occurs. In this case, the outer periphery of the pressure roller 32 comes into contact with the outer periphery of the heating roller 33, and the state of pressure contact takes place.

The magnitude of the pressure contact of the pressure roller 32 with respect to the heating roller 33 is determined by the force of the spring member 54. It can be adjusted as desired, by proper selection of the position of the flat portion or the projecting dimension of the guide projection 52*b* in such a way that the flat portion of the cam 51 will contact the guide projection 52*b*. Further, the magnitude of the pressure contact of the pressure roller 32 with respect to the heating roller 33 can be chanced on a continuous basis by replacing the cam 51 with a deformed cam. This example is described later with the use of FIG. 8.

When the pressure roller 32 are brought in pressure contact with the heating roller 33, the heating roller 33 is driven by a motor 35 as a drive source and the pressure roller 32 is rotated by the heating roller 33. The heating roller 33 and pressure roller 32 provide heat and pressure while the recording medium P is sandwiched by the fixing nip and is conveyed, so that the toner image on the recording medium P is fused and fixed in place. The rotation of the heating roller 33 by the motor 35 is controlled by the controller 101.

Further, to detect the temperature on the surface of the heating roller 33, the fixing device 34 is provided with a non-contact kind temperature detecting sensor S for detecting the temperature of the radiant heat from the heating roller 33, which is built in the casing, as shown in FIG. 4. The temperature detecting sensor S uses a resistance temperature sensor (thermistor, etc.). The result of detection by the temperature detecting sensor S is sent to the controller 101. The controller 101 controls the drive circuit (not illustrated) that turns on or off electric power to the heating means H, and makes adjustment to ensure that the temperature detected by the temperature detecting sensor S will reach the target control temperature.

The communication section 105 in FIG. 1 includes a modem, a LAN adaptor, a router, a TA (Terminal Adaptor) and others, and provides communication control with the host apparatus 200 connected to a communication network such as a LAN (Local Area Network) or WAN (Wide Area Network) via a communication line such as a leased line or ISDN line, thereby receiving printer codes and others.

The host apparatus 200 is a computer that supplies the image forming apparatus 100 with the control signal including the print start instruction, as well as printer codes.

The following describes the operation.

(First Operation Example)

FIG. 6 shows the heating roller temperature control provided by a controller 101 when the image forming apparatus 100 is placed in the idle state. The idle state is defined as the state where the temperature of the heating roller 33 of the fixing device 34 has been adjusted to the target control temperature by the warm-up operation, and the apparatus is ready for immediate printing. If the heating roller 33 and pressure roller 32 are kept in the state of pressure contact for a long time, the contact surface of the roller will be subjected to an adverse effect due to pressure contact to cause lack of uniformity in the fixed image. Accordingly, in the idle state, pressure contact of the heating roller 33 and pressure roller 32 is released.

In Step S1 of FIG. 6, the system waits for the print start instruction from the host apparatus 200. In Step S2, the system waits for a change in the setting of the print condition of at least one of the kind, weight and glossiness of paper from the setting screen (not illustrated) of the host apparatus 200 serving the functions of the recording medium setting section, weight setting section and glossiness setting section, or the setting screen (not illustrated) of the operation/display section 102. If the print start instruction is not issued from the host apparatus 200 (No in Step S1), there is a change in the setting of the print condition of at least one of the kind, weight and glossiness of paper from the setting screen (not illustrated) of the host apparatus 200 or operation/display section 102, and new conditions have been set (Yes in Step S2), then the system proceeds to the warm-up operation state (Step S3), and reception of a print start instruction is disabled. This is followed by the step of referencing the target control temperature table 111 and the target control temperature TO conforming to the set print conditions is obtained (Step S4). The present temperature TA of the heating roller 33 detected by the temperature detecting sensor S is compared with the target control temperature TO conforming to the set kind, weight and glossiness of paper (Step S5).

If the result of the aforementioned comparison shows that the present temperature TA is equal to the target control temperature TO (TA=TO in Step S5), the processing goes to Step S14. If the result of the aforementioned comparison shows that the present temperature TA of the heating roller 33 is lower than the target control temperature TO (TA<TO in Step S5), the heating means H is turned on (Step S6) and the system waits until the present temperature TA of the heating roller 33 reaches the target control temperature TO (Step S7). If the present temperature TA of the heating roller 33 is equal to the target control temperature TO (YES in Step S7), the processing goes to Step S14.

In the meantime, if the result of the aforementioned comparison shows that the present temperature TA of the heating roller 33 is higher than the target control temperature TO (TA>TO in Step S5), the heating roller 33 and pressure roller 32 are brought in pressure contact with each other by the pressure contact drive device 50 (Step S8). Both rollers are rotated (Step S9) and the heating means H is turned off to stop the power supply (Step S10). The system waits (Step S11) until the present temperature TA of the heating roller 33 is reduced to reach the target control temperature TO.

Here the heating roller 33 and pressure roller 32 are brought in pressure contact with each other, and the system waits until the present temperature of the heating roller 33 is reduced to reach the target control temperature TO, whereby the warm-up operation time can be reduced substantially by the endothermal effect of the pressure roller 32, as compared to the prior art where the system waits while contact pressure is released.

FIG. 7 shows the test data on the time required to reduce the temperature from 210 to 190° C. in the cases where the heating roller 33 and pressure roller 32 are brought in pressure contact with each other, and where the pressure contact is released. The heating roller 33 and pressure roller 32 at the time of this test are made of the material of three layers—aluminum, silicone rubber and PFA resin—as viewed from the inside to the outside. Further, when pressure contact was applied in the test, a pressure contact of 1000 N was applied between both rollers. As shown in FIG. 7, the test was conducted three times and the average in these tests was obtained. It was revealed that the temperature was reduced by the endothermal effect of the pressure roller 32 about fifty seconds earlier in the case where the system waited with the pressure contact applied, as compared to the case where the system waited with the pressure contact released. To put it another way, in the case where the system waits, with the pressure roller 32 brought in pressure contact with the heating roller 33, until the temperature falls to the level of the target control temperature TO, a substantial reduction in warm-up operation time is ensured, as compared to the case where the system waits with the pressure contact released.

Further, when the controller 101 controls the motor 35 so that the heating roller 33 rotates, the temperature distribution of both rollers can be made uniform by rotating both rollers to wait for the fall of temperature. Not only that, this arrangement prevents an adverse effect from occurring on the roll contact surfaces due to pressure contact, with the result that inconsistencies in density would occur on the fixed image, otherwise.

When the present temperature TA of the heating roller 33 has reached the target control temperature TO (YES in Step S11), the rotation of the heating roller 33 and pressure roller 32 stops (Step S12), and pressure contact between the heating roller 33 and pressure roller 32 is released by the pressure contact drive device 50 (Step S13). Then processing goes to Step S14.

When the present temperature TA of the heating roller 33 is equal to the target control temperature TO, the processing goes to Step S14. The system is placed in the idle state where a print start instruction can be received. A message "You can print" appears on the operation/display section 102 (Step S14). Then the heating means H is turned on/off, and the present temperature TA of the heating roller 33 is kept at the target control temperature TO (Step S15). Processing then goes back to Step S1.

When a print start instruction has been issued from the host apparatus 200 (YES in Step S1), printing is started by the print section 104 (Step S16) and the current processing terminates.

In the aforementioned embodiment, the target control temperature is used as a predetermined temperature. Without being restricted thereto, for example, a threshold value is set in response to the target control temperature, and this threshold value can be used as a predetermined temperature. To put it another way, a threshold value higher than the target control temperature is used as a predetermined temperature. If the present temperature TA of the heating roller is higher than this value, the heating roller and pressure roller can be moved relative to each other, in such a way that the relative distance between the heating roller and pressure roller will be reduced in order to reduce the temperature TA of the heating roller to the target control temperature.

As described above, according to the image forming apparatus 100, if the present temperature TA of the heating roller 33 detected by the temperature detecting sensor S is higher than the target control temperature TO, the heating roller 33 and pressure roller 32 are brought in pressure contact with each other, and both rollers are rotated. The heating means H is turned off, and the system waits until the present temperature TA of the heating roller 33 reaches the target control temperature TO. This arrangement of the image forming apparatus 100 provides a substantial cut-down of the warm-up operation time.

(Second Operation Example)

The following explains the second-operation example, where the description is restricted only to the differences from the first operation example.

Figure 9:
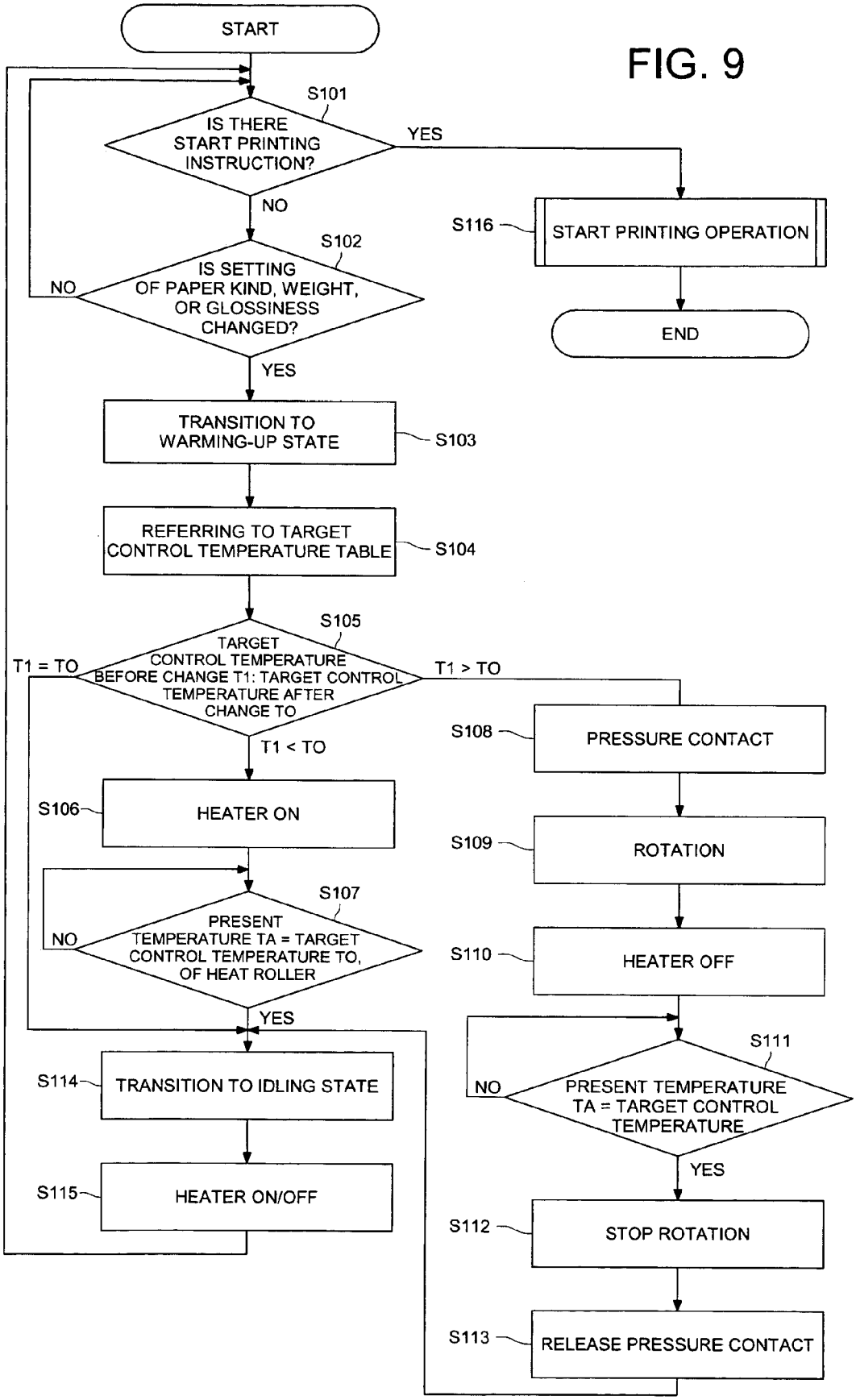
FIG. 9 is a flowchart representing the heating roller temperature control (second control operation) provided by a controller 101.

FIG. 9 (a diagram to be added) is a flowchart representing the operation when the image forming apparatus 100 is placed in the idle state.

The step in FIG. 9 different from that in FIG. 6 is Step S105. In Step S104, reference is made to the target control temperature table 111, and the target control temperature TO conforming to the kind, weight and glossiness of paper is acquired. Then comparison is made (in Step S105) between the older target control temperature T1 conforming to the kind, weight and glossiness of paper before setting is changed in Step S102, and the target control temperature TO acquired in Step S104.

If the T1 is equal to TO as a result of this comparison (T1=TO in Step S105), the processing goes to Step S114.

If the result of the aforementioned comparison shows that T1 is lower than TO, (T1<TO in Step S105), the heating means H is turned on (Step S106) and the system waits until the present temperature TA of the heating roller 33 reaches the target control temperature TO (Step S107).

In the meantime, if the result of the aforementioned comparison shows that T1 is higher than TO, (T1>TO in Step S105), the heating roller 33 and pressure roller 32 are brought in pressure contact with each other by the pressure contact drive device 50 (Step S108). Both rollers are rotated (Step S109) and the heating means H is turned off to stop the power supply (Step S110). The system waits (Step S111) until the present temperature TA of the heating roller 33 is reduced to reach the target control temperature TO.

(Variation)

The above description of the embodiment is a preferred example of the image forming apparatus 100 of the present invention, without the present invention being restricted thereto.

Figure 8:
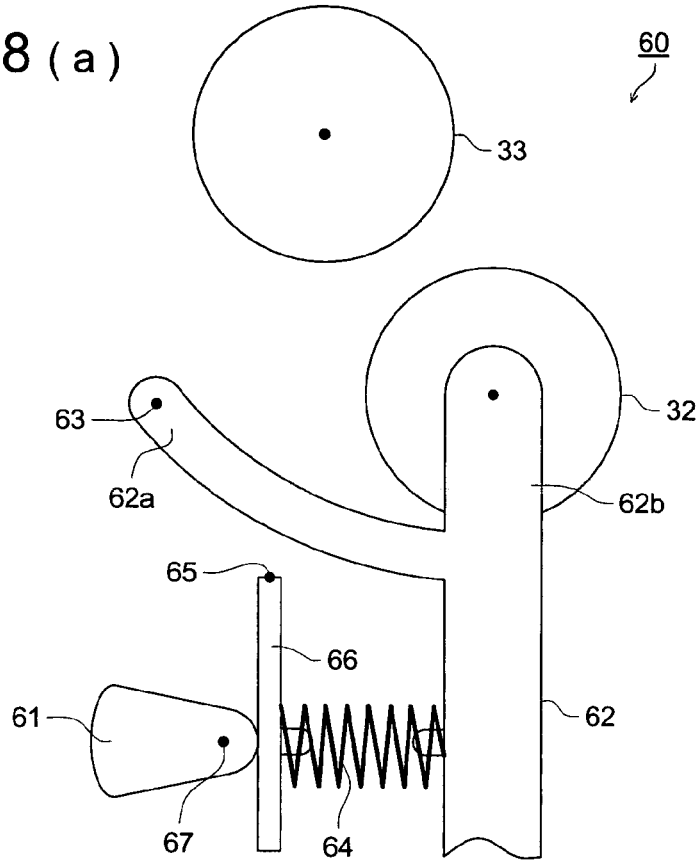
FIG. 8 is a cross sectional view representing an example of the configuration of a pressure contact drive apparatus 60.
Figure 8:
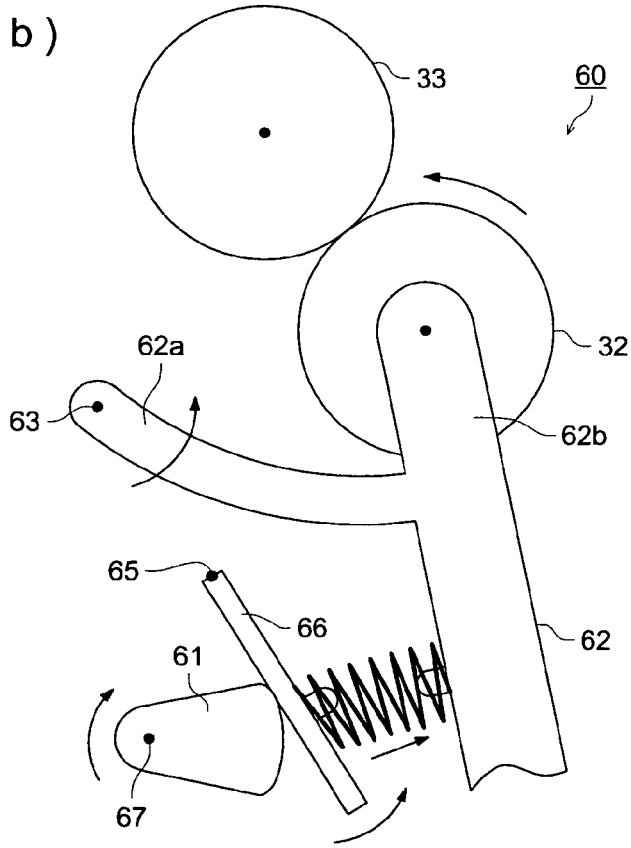

For example, if the pressure contact drive apparatus is designed in the same structure as the pressure contact drive apparatus 60 shown in FIG. 8, the pressure contact of the pressure roller 32 with respect to heating roller 33 can be changed on a continuous basis.

FIG. 8 is a cross sectional view representing the pressure contact drive apparatus 60. In this drawing, (*a*) shows that the pressure roller 32 is disengaged from the heating roller 33 (i.e. pressure contact is released), while (*b*) shows that the pressure roller 32 are brought in pressure contact with the heating roller 33.

As shown in FIGS. 8(*a*) and (*b*), in an approximately Y-shaped arm 62, the tip end of one arm 62*a* is journaled by the fulcrum 63 and the entire arm 62 is supported rotatably about the fulcrum 63. The tip end of the other arm 62*b* is fitted so that the pressure roller 32 can be rotated as required. The tip end of the arm 62 is provided with a spring member 64 that expands and contacts in the direction orthogonal to the arm 62. The tip end of the spring member 64 is in contact with the outer periphery of a deformed cam 61 through a movable strip 66. One end of the movable strip 66 is journaled by a fulcrum 65 and is rotatable about the fulcrum 65. The deformed cam 61 is formed in an approximate triangle. The rotary shaft 67 of the axis fulcrum is deviated in the direction of major diameter. To put it another way, the deformed cam 61 is journaled about the rotary shaft 67 in such a way that one side of the deformed cam 61 is longer in the direction of major diameter, and the other side is shorter. The rotary shaft 67 of the deformed cam 61 is connected to the rotary shaft of a drive motor (not illustrated).

When a pressure contact release command of the pressure roller 32 has been issued from the controller 101, the deformed cam 61 is driven and turned about the rotary shaft 67 by a motor (not illustrated), as shown in FIG. 8(*a*). The deformed cam 61 stops after rotating to the position where the distance from the rotary shaft 67 to the outer periphery of the deformed cam 61 in contact with the movable strip 66 is minimized. When the distance from the rotary shaft 67 to the outer periphery of the deformed cam 61 in contact with the movable strip 66 is minimized, the arm 62 is not pressed by the movable strip 66 or spring member 64. Accordingly, the outer periphery of the pressure roller 32 is disengaged from the outer periphery of the heating roller 33, hence the pressure contact is released.

In the meantime, when the pressure contact command of the pressure roller 32 has been issued from the controller 101, the deformed cam 61 is rotated about the rotary shaft 67 by the motor (not illustrated), as shown in FIG. 8(*b*), and the outer periphery of the cam 61 is brought in contact with the movable strip 66. The arm 62 is rotated in the counter-clockwise direction through the spring member 64, and the pressure roller 32 are brought in pressure contact with the heating roller 33. The pressure contact of the pressure roller 32 with respect to the heating roller 33 can be adjusted in response to the distance from the rotary shaft 67 subjected to a change in response to the rotation of the cam 61, to the outer periphery of the deformed cam 61 in contact with the movable strip 66.

In the present embodiment, if the surface temperature of the heating roller 33 is higher than the target control temperature, the pressure contact drive apparatus 60 is adjusted so that the pressure roller 32 are brought in pressure contact with the heating roller 33. Without being restricted thereto, the temperature of the heating roller 33 can be effectively reduced by the relative movement of the heating roller 33 and pressure roller 32 in such a way that the distance between the heating roller 33 and pressure roller 32 is shorter than the value when the target control temperature is measured.

To ensure a relative movement of the heating roller 33 and pressure roller 32 in such a way that the relative distance between the heating roller 33 and pressure roller 32 is shorter, a relative movement should be made in such a way as to reduce the distance between the rotary shafts of the heating roller and pressure roller. To put it another way, a relative movement of the heating roller and pressure roller can be made in such a way as to reduce the center distance to be shorter than the case where the heating roller and pressure roller are brought in contact with each other.

Preferably, the pressure contact drive apparatus 60 is controlled so that the heating roller 33 and pressure roller 32 are brought in pressure contact with each other, from the state where these rollers are disengaged from each other. The endothermal effect by the pressure roller 32 is increased as the contact pressure of the pressure roller 32 to the heating roller 33 is higher. Accordingly, from the viewpoint of endothermal effect, it is further preferred to allow the maximum pressure to be applied by the pressure contact drive apparatus 60. In the meantime, however, the contact surfaces between two rollers are more liable to be subjected to adverse effect due to pressure contact as the pressure is increased. Thus, the adverse effect on the roller contact surfaces due to pressure contact can be minimized by reducing the contact pressure of the pressure roller 32 to the heating roller 33, although the warm-up operation time is somewhat prolonged. Thus, it is preferred to make arrangements so that the contact pressure can be set by the operation/display section 102, depending on the effect on which a user places a greater priority.

In the above description of the embodiment, an electrophotographic color printer was taken as an example for explanation. Without being restricted thereto, the present invention is also applicable to a color copying machine, monochromatic copying machine, monochromatic printer, MFP (Multifunction Printer), facsimile machine and multifunctional apparatus.

In the above description of the embodiment, the case where only the heating roller is designed to incorporate the heating means was taken an example for explanation. When both the heating roller and pressure roller are designed to incorporate the heating means, the same effect can be obtained.

The present invention is also applicable to the cases where the image formed on the photoconductor drum is transferred directly onto the recording medium by the pressure contact of the roller for transfer to the photoconductor drum by bypassing an intermediate transfer member.

Further, the target control temperature table 111 shown in the above description is only one of the examples. However, the present invention is not restricted thereto. For example, in an image forming apparatus where the user is allowed to set one of the printing conditions—the kind of paper, for example—, it is sufficient to prepare a table that permits a target control temperature to be determined for each kind of paper that can be set.

Further, an example in an idle state was used in the above description of the embodiment. Without being restricted thereto, the present invention is applicable to the cases where the setting of the kind, weight and glossiness of the recording medium is changed during the warm-up operation.

The above description of the embodiment refers to the case where at least one of the settings of the kind, weight and glossiness of paper as categories of the recording medium is changed. It is also possible to make such arrangements that, even when these settings are not changed, the target control temperature is always acquired according to the set printing conditions, and the aforementioned control is provided, if at least one of these settings is set.

The detailed structure and operation of each device constituting the image forming apparatus 100 can be adequately modified without departing from the spirit of the invention.

As described above, when the temperature of the first fixing member is higher than a predetermined temperature, the moving section is controlled in such a way as to reduce the relative distance between the first and second fixing members. This arrangement allows reduction in the temperature of the first fixing member to be expedited by the endothermal effect of the second fixing member, whereby the time for lowering the temperature of the first fixing member can be reduced. Further, if the predetermined temperature is made to conform to the kind, weight and glossiness of recording medium, it is possible to reduce the time for getting the optimum fixing temperature for each recording medium.

When the temperature of the first fixing member is higher than the predetermined temperature, the moving section is controlled in such a way that the first fixing member contacts the second fixing member. This arrangement allows the reduction in the temperature of the first fixing member to be expedited. If the moving section is controlled in such a way as to cause a pressure contact between the first and second fixing members, the reduction in the temperature of the first fixing member can be further expedited.

Moreover, when the temperature of the first fixing member is higher than the predetermined temperature, control is provided in such a way that the first fixing member and the second fixing member are brought in pressure contact with each other. By the rotation of at least one of the first fixing member and the second fixing member, uniform temperature distribution of both fixing members is ensured, and adverse effect on the contact surfaces of both fixing members due to pressure contact is minimized, whereby inconsistencies in the density of a fixed image can be eliminated.

Further, when arrangements are so made as to permit adjustment of the contact pressure of the second fixing member with respect to the first fixing member, adjustment is possible to minimize the adverse effect on the contact surfaces of the fixing members due to pressure contact.

As described with reference to the aforementioned embodiment, when the target control temperature of the first fixing member conforming to the present kind of the recording medium is lower than the target control temperature conforming to the kind of the recording medium having been set previously, the moving section is controlled so as to reduce the relative distance between the first fixing member and second fixing member. This arrangement expedites reduction in the temperature of the first fixing member down to the temperature conforming to the present kind of the recording medium, whereby the time for lowering the temperature of the first fixing member is reduced.

What is claimed is:

1. An image forming apparatus comprising:

a recording medium setting section for setting a kind of a recording medium;

a fixing device for fixing a toner image formed on a recording medium onto the recording medium, the fixing device comprising a first fixing member equipped with a heating device and a second fixing member for making pressure contact of the recording medium to the first fixing member, wherein each of the first fixing member and the second fixing member is a body of rotation;

a moving section for relatively moving the first fixing member and the second fixing member; and a controller for controlling the moving section and the fixing device so that the first fixing member and the second fixing member that have been in the disengaged state are brought in pressure contact with each other, at least one of the first and the second fixing members is rotated, and the heating device is turned off, when a second target control temperature of the first fixing member conforming to a second kind of the recording medium set by the recording medium setting section is lower than a first target control temperature conforming to a first kind of the recording medium which had been previously set.

2. The image forming apparatus of claim 1, wherein each of the first fixing member and the second fixing member is a roller.

3. The image forming apparatus of claim 1, wherein the controller controls the moving section and the fixing device so that the first fixing member and the second fixing member that have been in the disengaged state are brought in pressure contact with each other, at least one of the first and the second fixing members is rotated, and the heating device is turned off, in cases where a changed kind of the recording medium has been set by the recording medium setting section, and a target control temperature of the first fixing member conforming to the changed kind of the recording medium is lower than a target control temperature conforming to a kind of the recording medium which had been set before the changed kind of the recording medium.

4. The image forming apparatus of claim 1, wherein the recording medium setting section is capable of setting a weight of a recording medium, and wherein the first target control temperature is a temperature conforming to the weight of the first recording medium, and the second target control temperature is a temperature conforming to the weight of the second recording medium.

5. The image forming apparatus of claim 1, wherein the recording medium setting section is capable of setting a glossiness of a recording medium, and wherein the first target control temperature is a temperature conforming to the glossiness of the first recording medium, and the second target control temperature is a temperature conforming to the glossiness of the second recording medium.

6. The image forming apparatus of claim 1, wherein the moving section is capable of adjusting a contact pressure of the second fixing member to the first fixing member.

7. The image forming apparatus of claim 1, further comprising a temperature detector for detecting a temperature of the first fixing member, wherein the controller controls the moving section and the fixing device so that the first fixing member and the second fixing member that have been in the disengaged state are brought in pressure contact with each other, at least one of the first and the second fixing members is rotated, and the heating device is turned off, when the temperature of the first fixing member detected by the temperature detector is higher than the target control temperature of the first fixing member conforming to the kind of the recording medium set by the recording medium setting section.

8. An image forming apparatus, comprising:

a fixing device for fixing a toner image formed on a recording medium onto the recording medium, the fixing device comprising a first fixing member equipped with a heating device and a second fixing member for making pressure contact of the recording medium to the first fixing member, wherein each of the first fixing member and the second fixing member is a body of rotation;

a moving section for relatively moving the first fixing member and the second fixing member;

a temperature detector for detecting a temperature of the first fixing member;

a recording medium kind setting section for setting a kind of the recording medium; and a controller for controlling the moving section and the fixing device so that the first fixing member and the second fixing member that have been in the disengaged state are brought in pressure contact with each other, at least one of the first and the second fixing members is rotated, and the heating device is turned off, in cases where a changed kind of the recording medium has been set by the recording medium setting section, and the temperature of the first fixing member detected by the temperature detector is higher than a predetermined temperature conforming to the changed kind of the recording medium being set by the recording medium setting section.

9. An image forming apparatus, comprising:

a fixing device for fixing a toner image formed on a recording medium onto the recording medium, the fixing device comprising a first fixing member equipped with a heating device and a second fixing member for making pressure contact of the recording medium to the first fixing member, wherein each of the first fixing member and the second fixing member is a body of rotation;

a moving section for relatively moving the first fixing member and the second fixing member;

a temperature detector for detecting a temperature of the first fixing member;

a recording medium kind setting section for setting a kind of the recording medium, wherein the recording medium kind setting section is capable of setting a weight of the recording medium; and a controller for controlling the moving section and the fixing device so that the first fixing member and the second fixing member that have been in the disengaged state are brought in pressure contact with each other, at least one of the first and the second fixing members is rotated, and the heating device is turned off, in cases where a changed weight of the recording medium has been set by the recording medium setting section, and the temperature of the first fixing member detected by the temperature detector is higher than a predetermined temperature conforming to the changed weight of the recording medium being set by the recording medium setting section.

10. An image forming apparatus, comprising:

a fixing device for fixing a toner image formed on a recording medium onto the recording medium, the fixing device comprising a first fixing member equipped with a heating device and a second fixing member for making pressure contact of the recording medium to the first fixing member, wherein each of the first fixing member and the second fixing member is a body of rotation;

a moving section for relatively moving the first fixing member and the second fixing member;

a temperature detector for detecting a temperature of the first fixing member;

a recording medium kind setting section for setting a kind of the recording medium, wherein the recording medium setting section is capable of setting a glossiness of the recording medium; and a controller for controlling the moving section and the fixing device so that the first fixing member and the second fixing member that have been in the disengaged state are brought in pressure contact with each other, at least one of the first and the second fixing members is rotated, and the heating device is turned off, in cases where a changed glossiness of the recording medium has been set by the recording medium setting section, and the temperature of the first fixing member detected by the temperature detector is higher than a predetermined temperature conforming to the changed glossiness of the recording medium being set by the recording medium setting section.

* * * * *